US010702083B2

(12) United States Patent
Bishop et al.

(10) Patent No.: US 10,702,083 B2
(45) Date of Patent: Jul. 7, 2020

(54) SYSTEMS FOR USE WITH DRINKING CONTAINERS TO PROVIDE FLOWS OF AIR TO USERS

(71) Applicants: Ricky Joe Bishop, Warm Springs, GA (US); Samuel Shawn Klement, Dothan, AL (US)

(72) Inventors: Ricky Joe Bishop, Warm Springs, GA (US); Samuel Shawn Klement, Dothan, AL (US)

(73) Assignee: SOUTHERN TECHNOLOGIES GROUP, LLC, Ashburn, GA (US)

( * ) Notice: Subject to any disclaimer, the term of this patent is extended or adjusted under 35 U.S.C. 154(b) by 41 days.

(21) Appl. No.: 15/998,704

(22) Filed: Aug. 16, 2018

(65) Prior Publication Data

US 2019/0053650 A1 Feb. 21, 2019

Related U.S. Application Data

(60) Provisional application No. 62/546,281, filed on Aug. 16, 2017.

(51) Int. Cl.
*A47G 19/22* (2006.01)
*B65D 47/06* (2006.01)
(Continued)

(52) U.S. Cl.
CPC ..... *A47G 19/2288* (2013.01); *A47G 19/2205* (2013.01); *A47G 19/2227* (2013.01);
(Continued)

(58) Field of Classification Search
CPC ..... A47G 19/2288; A47G 19/2205; A47G 19/2227; B65D 81/3865; B65D 2543/00046; B65D 53/02; B65D 51/24
See application file for complete search history.

(56) References Cited

U.S. PATENT DOCUMENTS 3,935,077 A * 1/1976 Dennison ..... B01D 3/00 202/83
6,227,004 B1 * 5/2001 Gerstein ..... A47G 19/2288 62/421

(Continued)

FOREIGN PATENT DOCUMENTS

KR 101450251 B1 * 10/2014

OTHER PUBLICATIONS

Airwirl Personal Cooling & Heating System by Airwirl-Kickstarter, https://www.kickstarter.com/projects/745641142/airwirltm-personal-cooling-and-heating-system (printed Aug. 15, 2018).

*Primary Examiner* — Kun Kai Ma
(74) *Attorney, Agent, or Firm* — McClure, Qualey & Rodack, LLP

(57) ABSTRACT

A representative system for use with a drinking container to provide a flow of air to a user includes: a lid assembly with a lid base configured to removably mount to the drinking container and having a drinking opening, and an exterior housing defining an interior compartment and having an air outlet; a fan mounted within the interior compartment; and a heat exchanger mounted to the lid assembly and extending downwardly from the lid assembly and toward a bottom of the drinking container; wherein, in operation, air is directed via rotation of the fan into the fan into a heat exchange relationship with the heat exchanger and then outwardly through the air outlet as the flow of air; and wherein the lid assembly is configured to permit flow of the thermal medium from within the drinking container and through the drinking opening for drinking by the user while the lid base is mounted to the open end of the drinking container and the fan is providing the flow of air.

18 Claims, 9 Drawing Sheets

(51) Int. Cl.

| | |
|---|---|
| ***B65D 51/24*** | (2006.01) |
| ***B65D 81/38*** | (2006.01) |
| ***B65D 53/02*** | (2006.01) |
| ***F04D 25/08*** | (2006.01) |

(52) U.S. Cl.
CPC ..... *B65D 47/06* (2013.01); *B65D 51/24* (2013.01); *B65D 53/02* (2013.01); *B65D 81/3865* (2013.01); *B65D 2543/00046* (2013.01); *F04D 25/084* (2013.01)

(56) References Cited

U.S. PATENT DOCUMENTS

| | | | | |
|---|---|---|---|---|
| 2008/0302711 | A1* | 12/2008 | Windmiller | B65D 47/24 210/137 |
| 2009/0211152 | A1* | 8/2009 | Meeuws | A01G 5/06 47/41.01 |
| 2010/0000150 | A1* | 1/2010 | Meeuws | A01G 5/06 47/41.01 |
| 2015/0191684 | A1* | 7/2015 | Kyle | C12C 12/00 426/425 |
| 2015/0191685 | A1* | 7/2015 | Kyle | C12C 12/00 99/277.1 |
| 2016/0236605 | A1* | 8/2016 | Doi | B60N 3/106 |
| 2016/0346746 | A1* | 12/2016 | Rage | B01F 3/1221 |
| 2016/0360917 | A1* | 12/2016 | Richardson | A47J 31/005 |
| 2017/0225833 | A1* | 8/2017 | Ni | B65D 23/12 |
| 2017/0307282 | A1* | 10/2017 | Jelley | F25D 17/06 |
| 2018/0020854 | A1* | 1/2018 | Kim | A47G 19/2272 62/457.9 |
| 2018/0298909 | A1* | 10/2018 | Castle | F04D 25/084 |
| 2018/0327154 | A1* | 11/2018 | Solan | B65D 51/18 |
| 2019/0162460 | A1* | 5/2019 | Oh | F25D 16/00 |
| 2019/0257577 | A1* | 8/2019 | Waltzing | F25B 21/02 |

* cited by examiner

SYSTEMS FOR USE WITH DRINKING CONTAINERS TO PROVIDE FLOWS OF AIR TO USERS

CROSS REFERENCE TO RELATED APPLICATION

This utility application claims the benefit of and priority to U.S. Provisional Patent Application 62/546,281, filed on 16 Aug. 2017, which is incorporated by reference herein in its entirety.

BACKGROUND

Technical Field

The disclosure generally relates to systems for use with drinking containers, the contents of which may be used to provide heating and/or cooling to the users of the drinking containers.

Description of the Related Art

Solutions for providing heating and/or cooling in a portable device are many. While such devices have met with varying degrees of success, there still appears to be a need for a device that can provide heating and cooling at the discretion of the user. The ability to provide this functionality in a device that is durable and of low cost has been even more elusive.

SUMMARY

Systems for use with drinking containers to provide flows of air to users are provided. An example embodiment, among various others, is a system in which a temperature of the air is associated with a temperature of a thermal medium in the drinking container. In particular, the system comprises: a lid assembly having a lid base and an exterior housing, the lid base being configured to removably mount to an open end of the drinking container to close the open end, the lid base having a drinking aperture defining a drinking opening, the exterior housing defining an interior compartment and having an air outlet, which pneumatically communicates with the interior compartment; a fan mounted within the interior compartment; and a heat exchanger mounted to the lid assembly and extending downwardly from the lid assembly and toward a bottom of the drinking container such that the heat exchanger draws thermal energy from the thermal medium in the drinking container; wherein, in operation, air is directed via rotation of the fan into a heat exchange relationship with the heat exchanger and then outwardly through the air outlet as the flow of air; and wherein the lid assembly is configured to permit flow of the thermal medium from within the drinking container and through the drinking opening for drinking by the user while the lid base is mounted to the open end of the drinking container and the fan is providing the flow of air.

In some embodiments, an annular seal is positioned about the lid base and configured to prevent leakage of the thermal medium between the drinking container and the lid base.

In some embodiments, an air inlet is positioned above the seal such that, when mounted to the open end of the drinking container, the air inlet is positioned outside of the drinking container.

In some embodiments, in operation, at least some of the air entering the air inlet is directed downwardly into the heat exchanger and then upwardly toward the fan housing before being directed outwardly through the air outlet.

In some embodiments, the air inlet is defined by the exterior housing.

In some embodiments, the air inlet is defined by the lid base.

In some embodiments, the lid base has an upper surface defining a liquid reservoir, the drinking aperture being positioned within the liquid reservoir; and the air outlet is positioned outside of the liquid reservoir.

In some embodiments, the heat exchanger has an exterior surface formed of metal.

In some embodiments, the heat exchanger has a downwardly-directed flow portion and an upwardly-directed return flow portion.

In some embodiments, the system further comprises a fan housing, mounted within the interior compartment, and within which the fan is mounted; and an outside surface of the fan housing and an inside surface of the exterior housing define a heat exchange flow path configured to direct at least some of the air entering the air inlet downwardly and into the heat exchange relationship with the heat exchanger.

In some embodiments, the lid base has a lower surface and a fan inlet, the fan inlet having a fan aperture, defining a fan opening in the lid base, and a fan inlet conduit positioned about the fan opening and extending downwardly from the lower surface of the lid base; and the heat exchange flow path is defined, at least in part, by the fan inlet conduit such that the air entering the heat exchange relationship with the heat exchanger flows downwardly outside of the fan inlet conduit and then is drawn upwardly and into the fan housing via the fan inlet conduit and through the fan opening.

In some embodiments, the drinking aperture is configured such that a drinking straw is receivable within the drinking opening.

In some embodiments, the drinking straw and/or the drinking container are provided.

In some embodiments, the drinking container is a tumbler.

In some embodiments, a battery is mounted within the exterior housing.

In some embodiments, the battery is a rechargeable battery; and the system further comprises a charging unit electrically communicating with the rechargeable battery, the charging unit having a charging circuit mounted within the exterior housing and a charging port mounted to the exterior housing.

In some embodiments, a centerline of the fan is offset with respect to a centerline of the lid base such that the centerline of the lid base is located between the drinking aperture and the centerline of the fan.

Other systems, methods, features, and advantages of the present disclosure will be or may become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
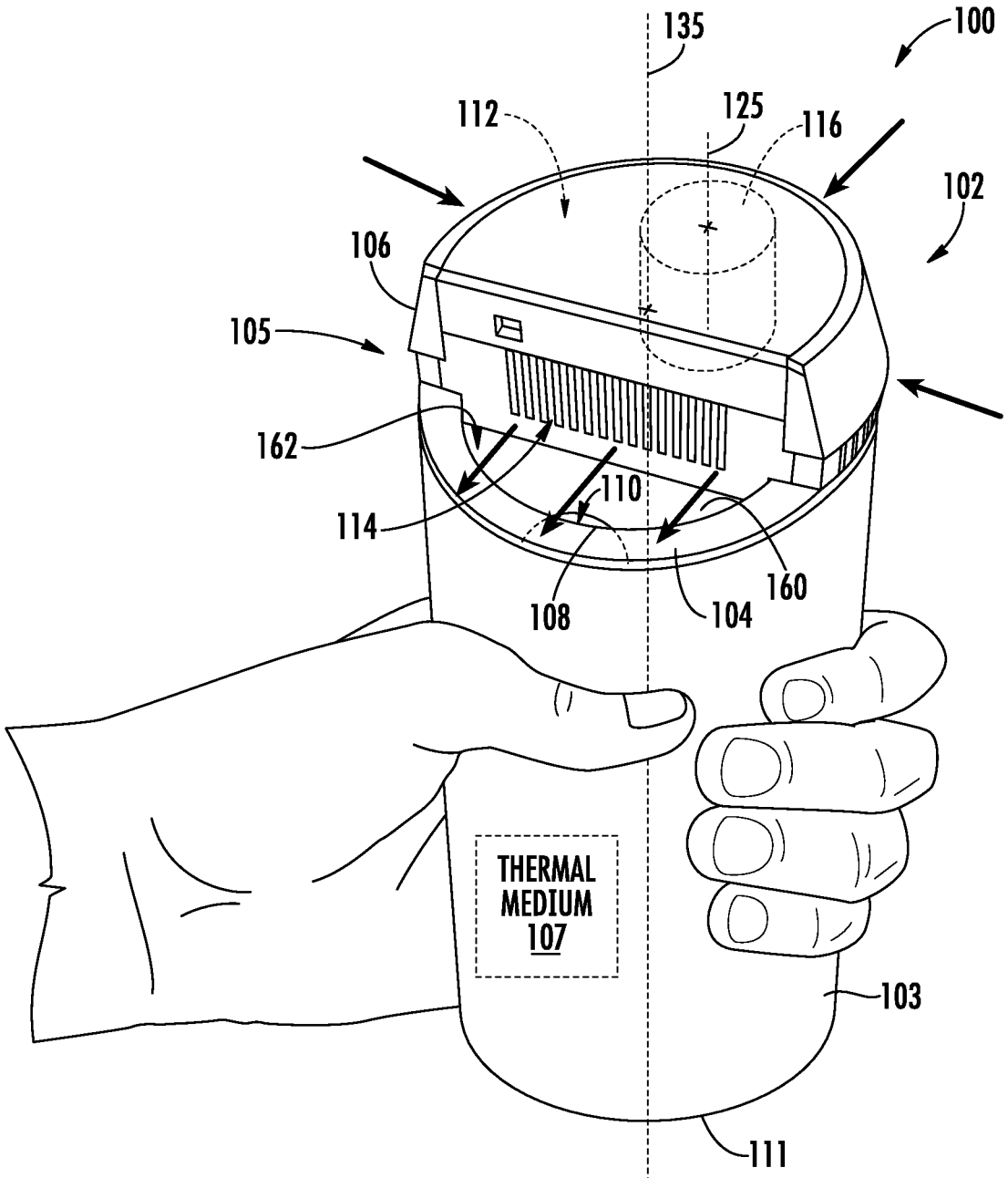
FIG. 1 is a schematic diagram of an example embodiment of a system showing a lid assembly mounted to a drinking container.
Figure 2:
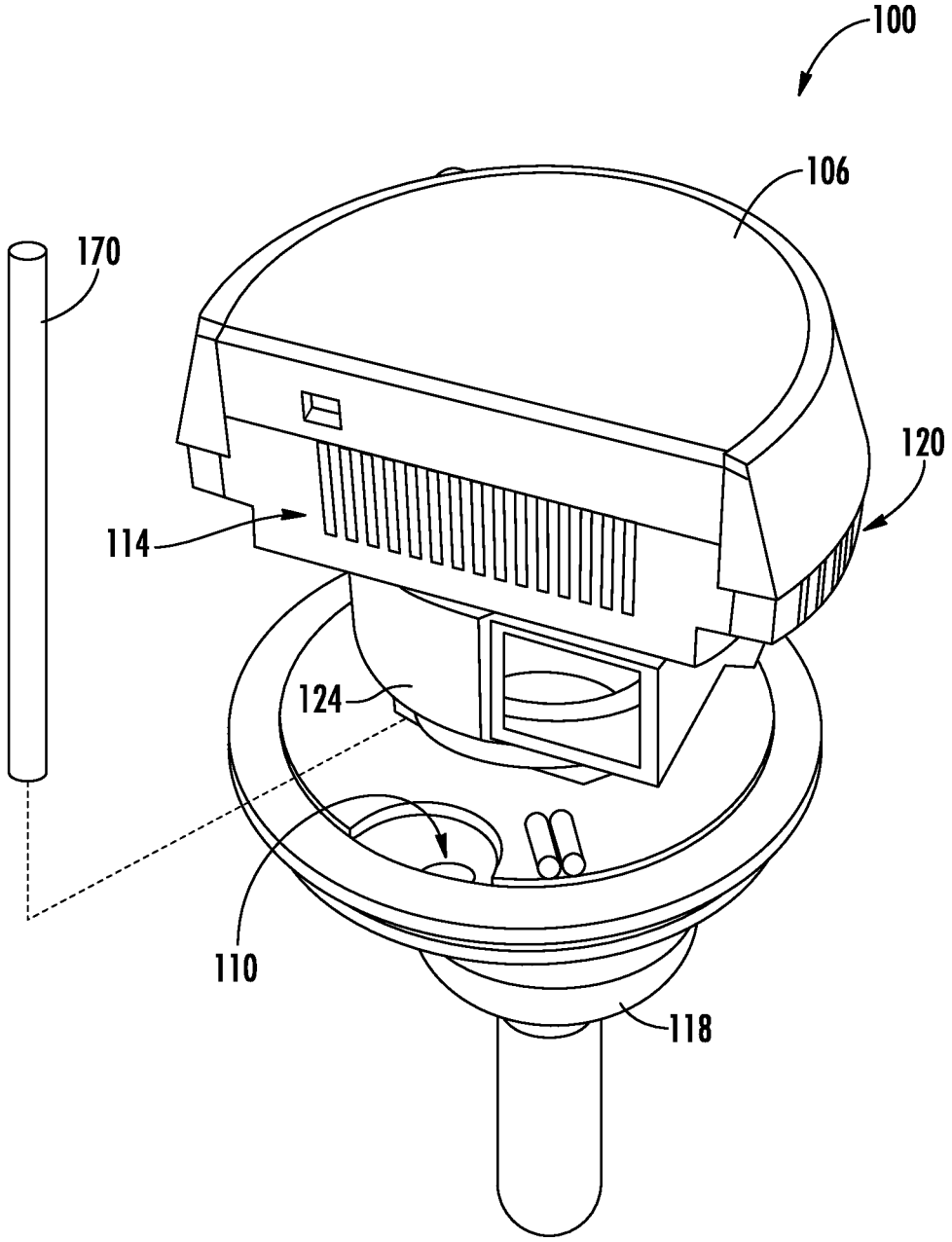
FIG. 2 is an assembly view of the embodiment of FIG. 1.
Figure 3:
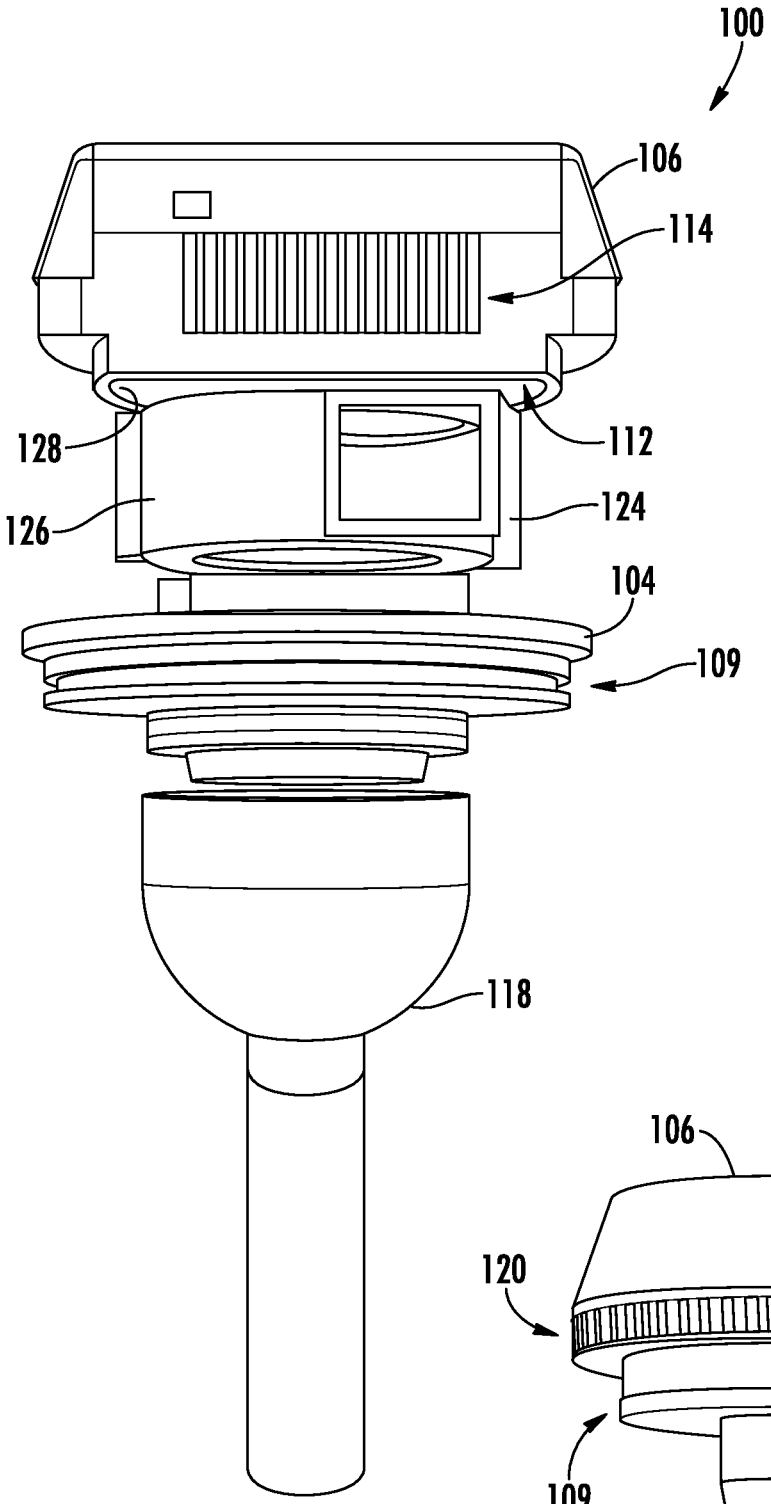
FIG. 3 is an assembly view of the embodiment of FIGS. 1 and 2.

As will be described in detail, the present disclosure involves systems for use with drinking containers to provide flows of air to users. In particular, a temperature of the air provided by such a system is associated with a temperature of a thermal medium (which may be ice water or hot coffee, for example) contained in the drinking container. By changing a temperature of the thermal medium, the temperature of the air may be adjusted by the user to provide cooling or heating as desired. Simultaneously, access to the thermal medium may be provided for drinking by the user while flows of air are being provided.

Reference will now be made to an example embodiment, which is depicted in various views and states of assembly in FIGS. 1-7. As shown, system 100 includes a lid assembly 102 with a lid base 104 and an exterior housing 106. Lid base 104 is configured to removably mount to an open end 105 of a drinking container 103. Specifically, in the mounted position depicted in FIG. 1, lid base 104 closes the open end to entrap contents (e.g., thermal medium 107) within drinking container 103. In some embodiments (see FIG. 3, for example), an annular seal 109 is positioned about the lid base and configured to prevent leakage of the thermal medium between drinking container 103 and lid base 104. Such an annular seal may be formed of rubber, for example.

Lid base 104 incorporates a drinking aperture 108 that defines a drinking opening 110, which is configured to facilitate drinking of contents (e.g., thermal medium 107) contained within drinking container 103. In some embodiments, drinking container 103 is an insulated container suited for carrying beverages (e.g., a tumbler). It should be noted that lid assembly 102 (and, specifically, lid base 104) may serve as a replacement lid for a drinking container. In this regard, many drinking containers exhibit common dimensions associated with their open ends, thus permitting a lid base to be used with many such containers. Additionally, in some embodiments, and owing to the range of opening-size accommodation provided by the annular seals, multiple containers with openings that vary in size may be accommodated by one lid assembly.

Exterior housing 106 defines an interior compartment 112 and includes an air outlet 114, which pneumatically communicates with interior compartment 112. A fan 116 is mounted within interior compartment 112. A heat exchanger 118 (see, FIG. 2, for example) is mounted to lid assembly 102. Heat exchanger 118 extends downwardly from lid assembly 102 and toward a bottom 111 of drinking container 103. In some embodiments, the heat exchanger is at least partially formed of metal, such as stainless steel, for example. In some embodiments, at least the exterior surface of the heat exchanger is formed of metal. Notably, heat exchanger 118 is configured to draw thermal energy from thermal medium 107 and transfer the thermal energy to the flow of air.

In operation, air (depicted by the arrows in FIGS. 1 and 7, for example) is directed via rotation of fan 116 into a heat exchange relationship with heat exchanger 118 and then outwardly through air outlet 114 as the flow of air. Owing to the orientation of air outlet 114, the air tends to be directed toward a user of drinking container 103 since the air outlet directs the air over drinking opening 110. Additionally, drinking opening 110 is configured to permit flow of thermal medium 107 from within drinking container 103 for drinking by the user while lid base 104 is mounted to open end 105 of the drinking container and, if desired, while fan 116 is providing the flow of air. Of significance, the thermal medium within the drinking container 103 tends to remain in a heat exchange relationship (e.g., in direct contact) with heat exchanger 118, even when drinking container 103 and the mounted lid assembly 102 are tilted to facilitate drinking of the thermal medium by the user. This is at least partially attributable to the configuration of the heat exchanger, which extends downwardly and often into the thermal medium.

Figure 4:
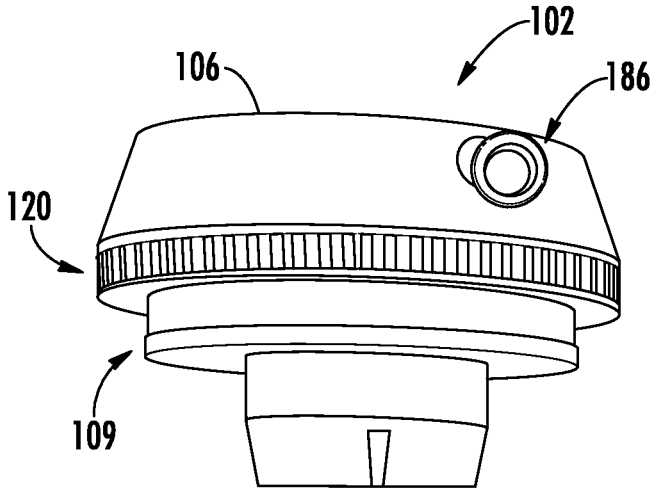
FIG. 4 is rear view of the lid assembly of FIGS. 1-3.
Figure 5:
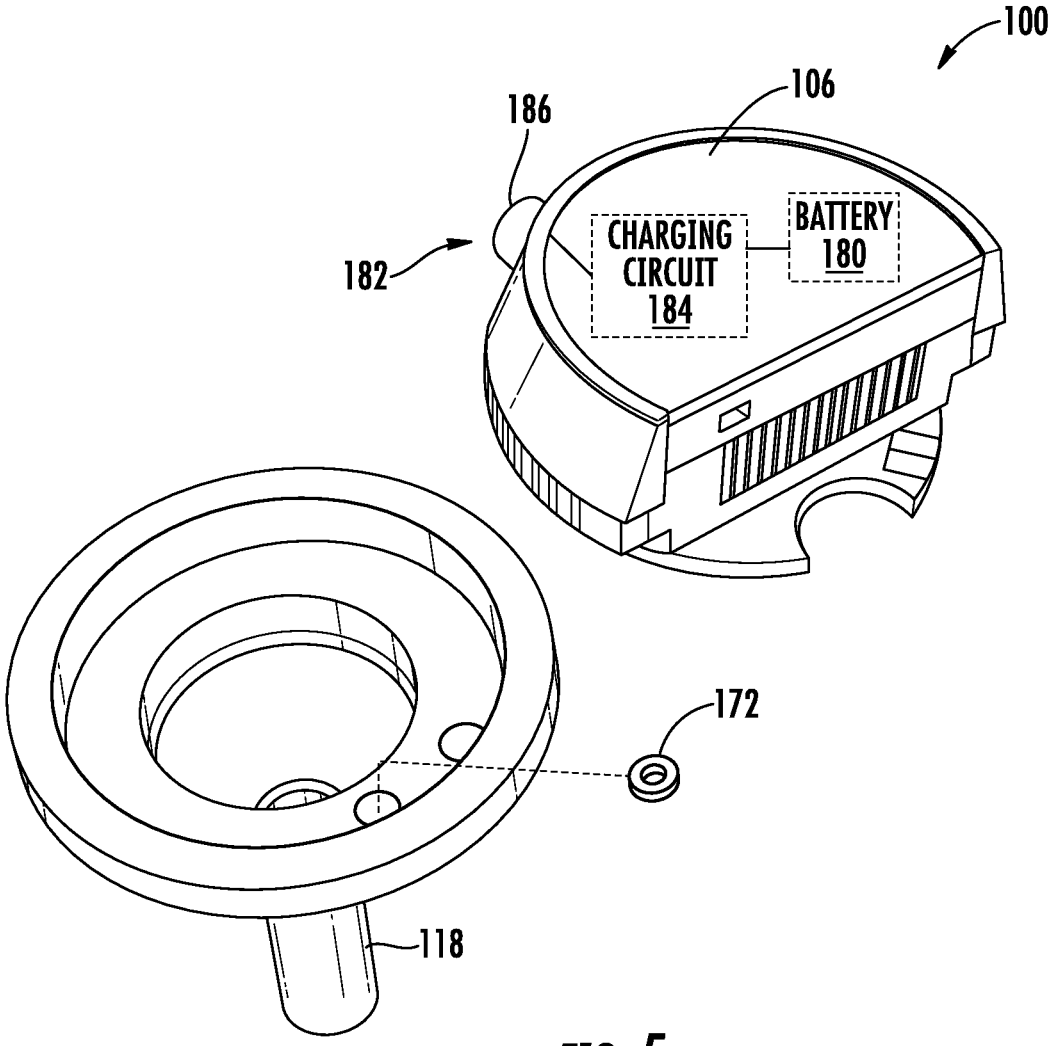
FIGS. 5 and 6 are assembly views of the embodiment of FIGS. 1-4.

In some embodiments (such as depicted in FIG. 4), an air inlet 120 is positioned above annular seal 109 that pneumatically communicates with interior compartment 112. So configured, when mounted to the open end of drinking container 103, air inlet 120 is positioned outside of an outer perimeter of the drinking container to permit an inwardly directed flow of air. It should be noted that, in the embodiment of FIGS. 1-6, air inlet 120 is defined by apertures formed through exterior housing 106.

In some embodiments (as best shown in FIG. 1), a centerline 125 of fan 116 is offset with respect to a centerline 135 of lid base 104, with centerline 135 of the lid base being located between drinking aperture 108 and centerline 125 of the fan. This configuration accommodates placement of the drinking opening at a location downstream of the outwardly flow of air from the fan.

The embodiment of FIGS. 1-6 also incorporates a fan housing 124 that is mounted within interior compartment 112. Fan 116 is mounted within fan housing 124. This configuration permits an outside surface 126 of fan housing 124 and an inside surface 128 of exterior housing 106 to define, at least in part, a heat exchange flow path 130 (FIG. 7). Heat exchange flow path 130 is configured to direct at least some of the air entering air inlet 120 downwardly and into a heat exchange relationship with heat exchanger 118.

Figure 6:
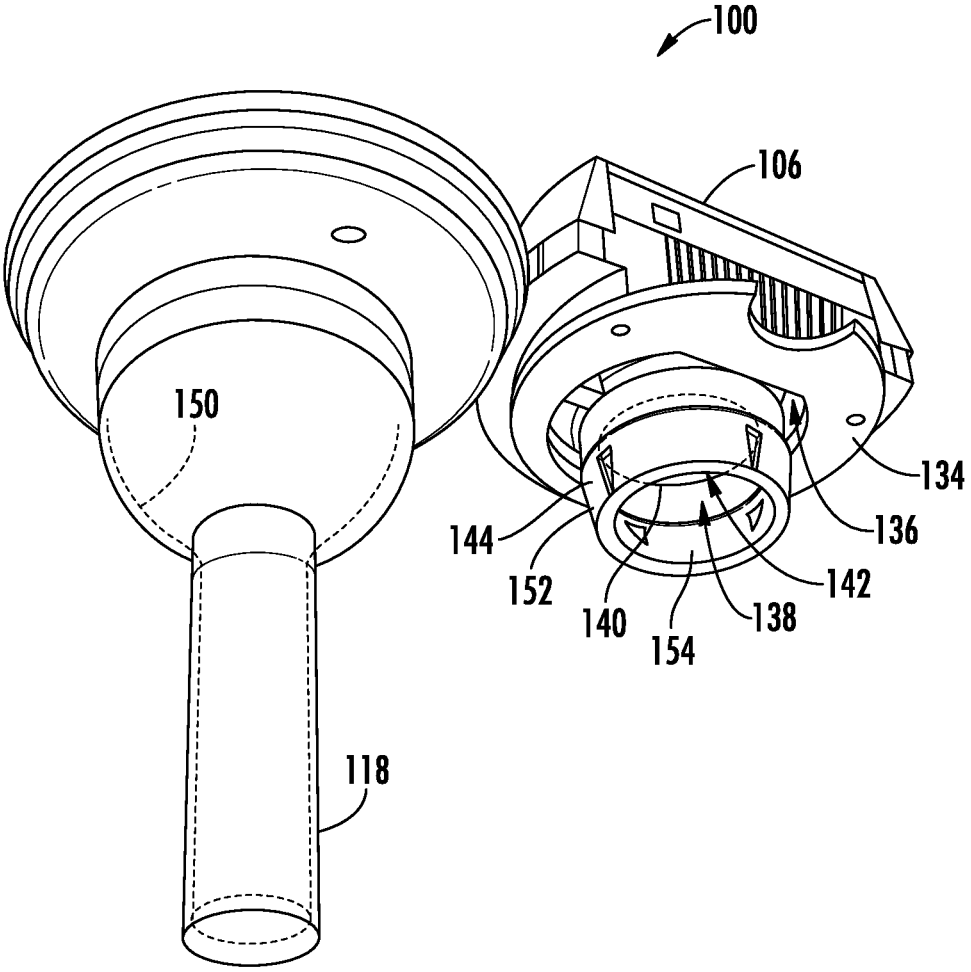
Figure 7:
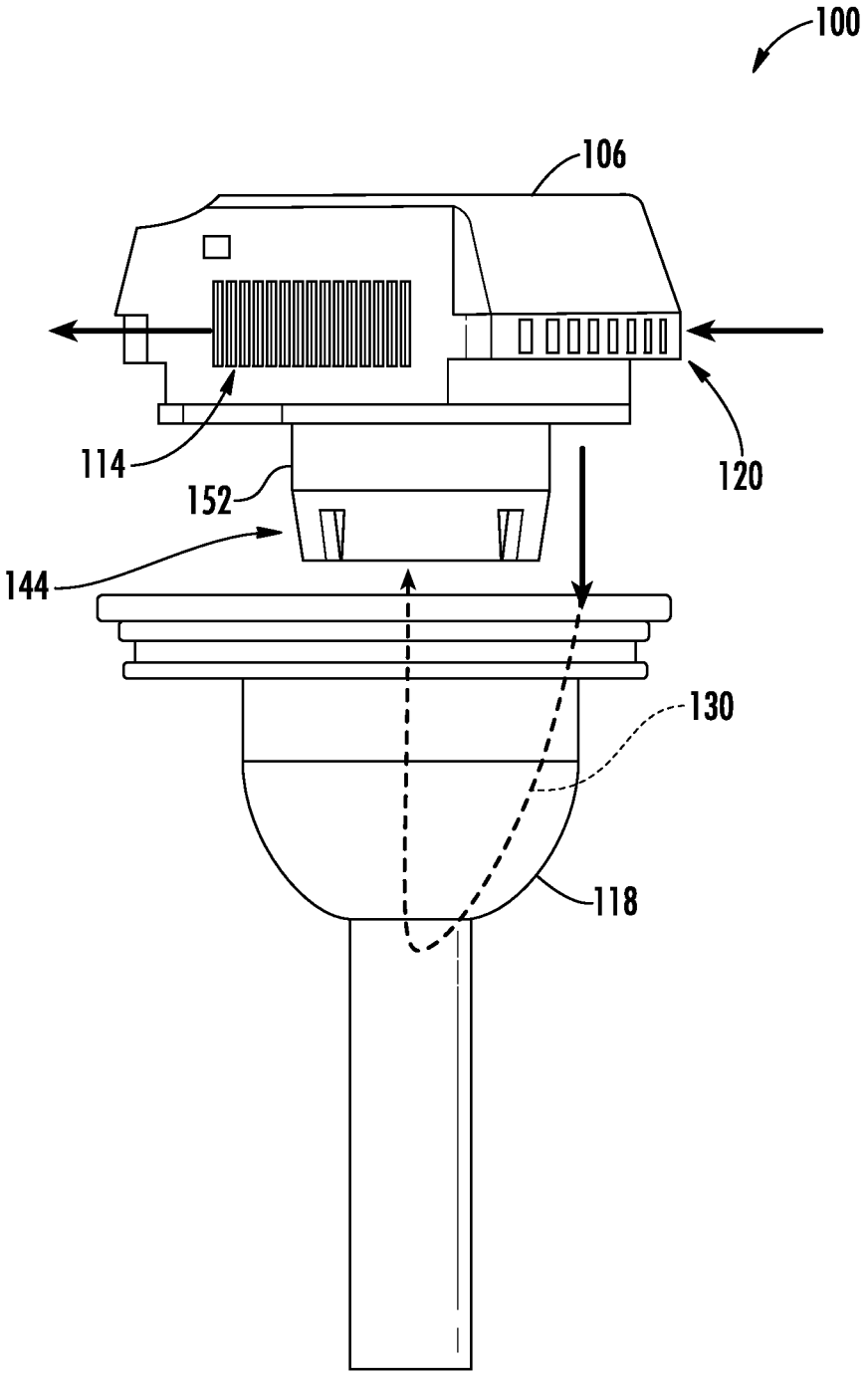
FIG. 7 is a schematic diagram depicting representative flows of air during operation of the embodiment of FIGS. 1-6.

In some embodiments (such as depicted in FIG. 6), lid base 104 includes a lower surface 134, a heat exchanger inlet 136, and a fan inlet 138. One or both of these inlets may incorporate multiple apertures. Fan inlet 138 incorporates a fan aperture 140 that defines a fan opening 142 in lid base 104. A fan inlet conduit 144 is positioned about fan opening 142 and extends downwardly from lower surface 134. Thus, the heat exchange flow path 130 is defined by air inlet 120, outside surface 126 of fan housing 124 and an inside surface 128 of exterior housing 106, an inside surface 150 of heat exchanger 118 and an outside surface 152 of fan inlet conduit 144, and then an inside surface 154 of fan inlet conduit 144. So configured, the air entering air inlet 120 is directed into a heat exchange relationship with heat exchanger 118 by flowing downwardly outside of fan inlet conduit 144 and then upwardly and into fan housing 124 via fan inlet conduit 144 before being expelled from lid assembly 102 through air outlet 114 by fan 116.

In some embodiments (such as depicted in FIG. 1), lid base 104 includes an upper surface 160 that defines a liquid reservoir 162. Liquid reservoir 162 forms a recessed portion within which drinking aperture 108 is located. Additionally, air outlet 114 is positioned outside of (i.e., higher than) liquid reservoir 162. This configuration tends to prevent liquid that may collect in liquid reservoir 162 from entering air outlet 114.

In some embodiments, drinking aperture 108 is configured to receive a drinking straw (e.g., straw 170 of FIG. 2) within drinking opening 110. An optional grommet 172 (FIG. 5) also may be used to facilitate seating of a straw within the drinking opening.

In some embodiments, a battery 180 (depicted in FIG. 5), which is configured for powering fan 116, is mounted within exterior housing 106. By way of example, battery may be a rechargeable battery. In some embodiments, a charging unit 182 is provided within exterior housing 106 that electrically communicates with battery 180. Charging unit 182 incorporates a charging circuit 184, configured to charge the battery, and a charging port 186, which is configured to receive power from an external source.

Figure 8:
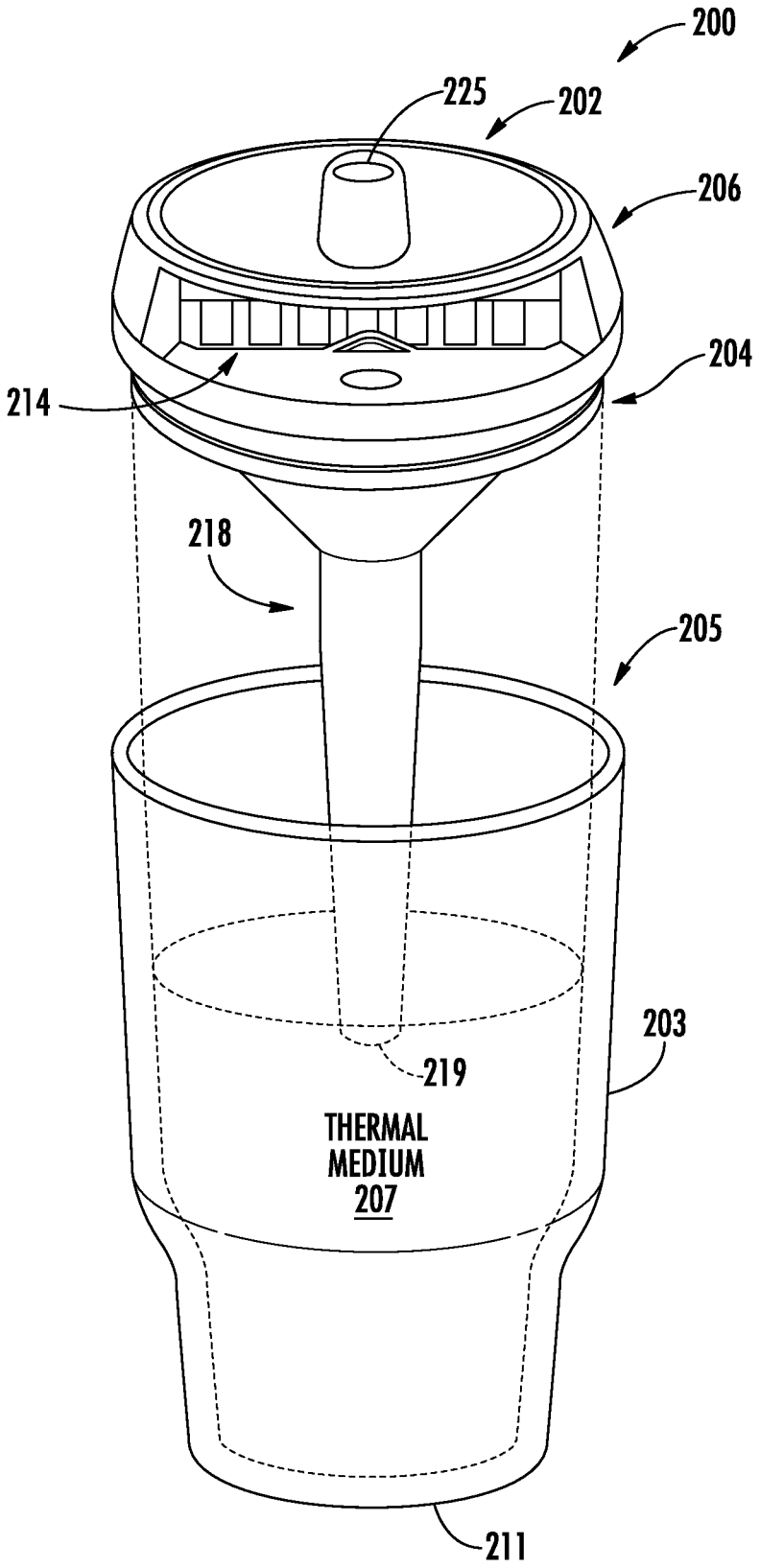
FIG. 8 is a schematic diagram of another example embodiment of a system.

FIG. 8 is a schematic diagram of another example embodiment of a system. In the embodiment of FIG. 8, system 200 includes a lid assembly 202 with a lid base 204 and an exterior housing 206. Lid base 204 is configured to removably mount to an open end 205 of a drinking container 203 to entrap contents (e.g., a thermal medium 207) within the drinking container. Also provided is a heat exchanger 218 that extends downwardly from lid assembly 202 and toward a bottom 211 of drinking container 203. In contrast to the previously-described embodiments, heat exchanger 218 is provided with a segmented and tapered configuration, the width of which narrows towards free end 219. Heat exchanger 218 transfers thermal energy to air that is expelled from lid assembly 202 via air outlet 214.

Also shown clearly in FIG. 8 is actuator 225, which may be actuated by a user for turning on/off the associated fan (not shown in FIG. 8).

Figure 9B:
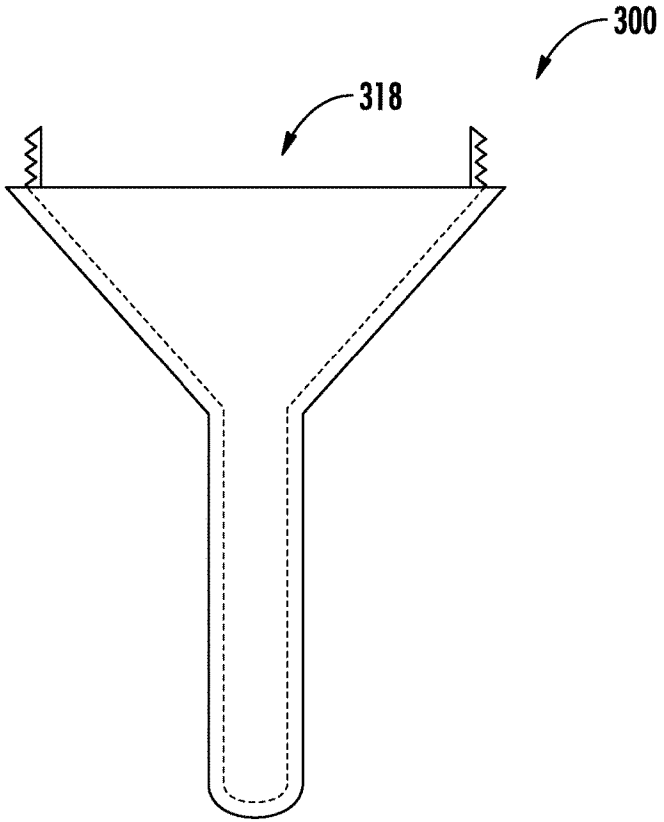
FIGS. 9A and 9B are schematic diagrams of another example embodiment of a system.
Figure 9A:
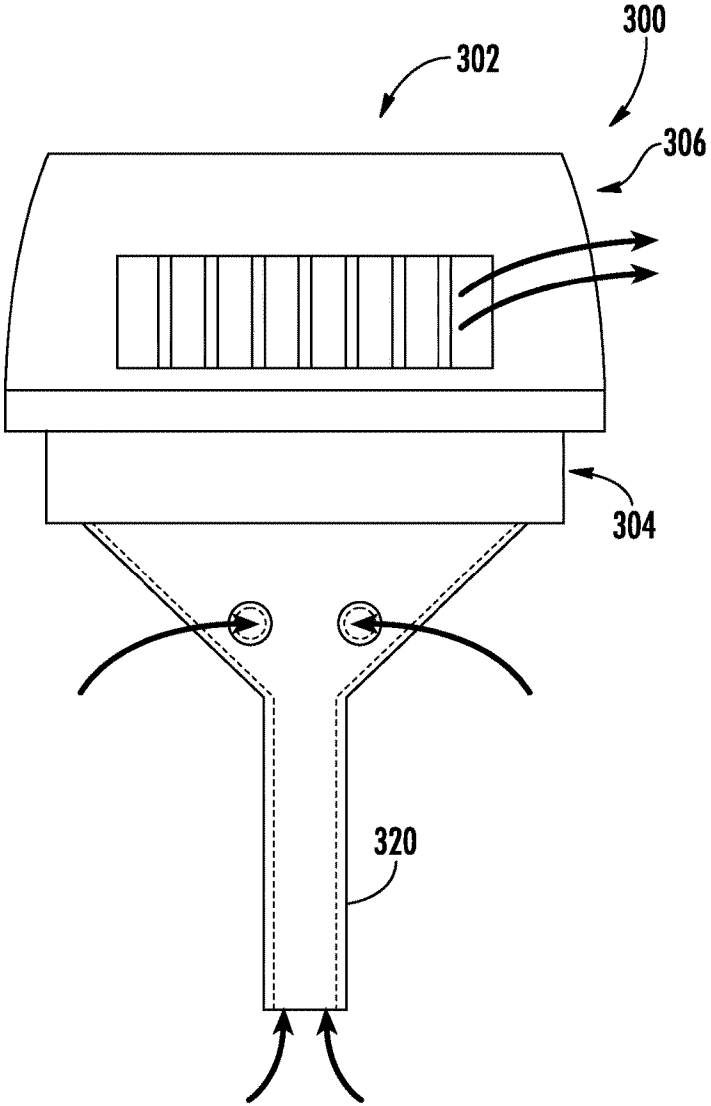

FIGS. 9A and 9B are schematic diagrams of another example embodiment of a system. In particular, system 300 includes a lid assembly 302 with a lid base 304 and an exterior housing 306 (FIG. 9A). A heat exchanger 318 (FIG. 9B), which in this embodiment is removable, is configured to extend downwardly from lid assembly 302 and about a fan inlet conduit 320. In contrast to the previously-described embodiments, fan inlet conduit 320 is configured with an exterior that tends to imitate the shape of the interior of heat exchanger 318 to increase heat transfer efficiency. Notably, heat exchanger 318 mounts to lid base 304 and about heat exchanger 318 when in an assembled configuration.

Figure 10:
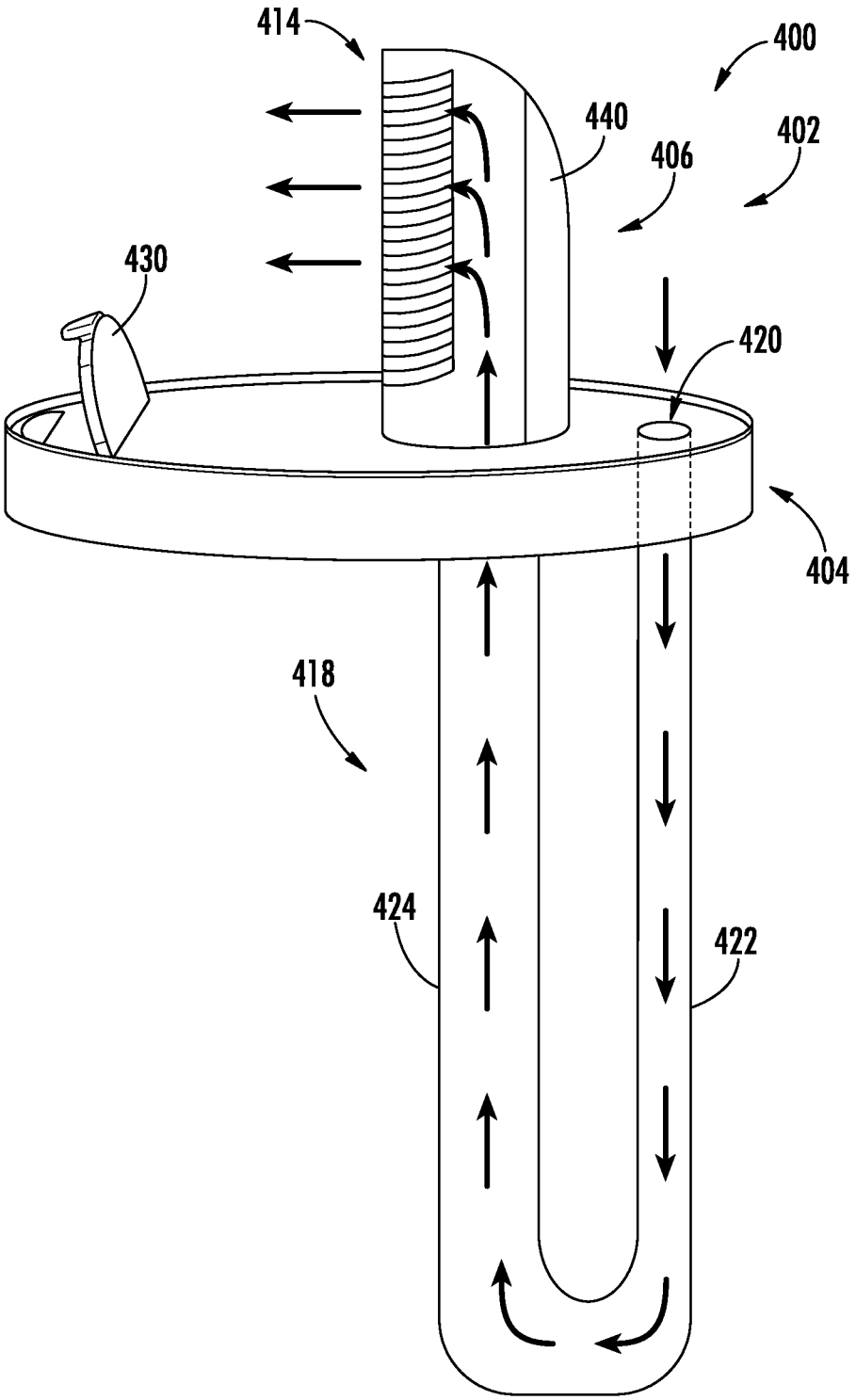
FIG. 10 is a schematic diagram of another example embodiment of a system.

FIG. 10 is a schematic diagram of another example embodiment of a system. As shown in FIG. 10, system 400 includes a lid assembly 402 with a lid base 404 and an exterior housing 406. A heat exchanger 418 extends downwardly from lid assembly 402 and is configured to receive a flow of air from an air inlet 420 that is defined by lid base 404. Notably, heat exchanger 418 is a generally U-shaped component that has a downwardly-directed flow portion 422 and an upwardly-directed return flow portion 424. Air from the heat exchanger is expelled from lid assembly 402 from air outlet 414. Additionally, lid assembly 402 includes a drink opening cover 430, which is movable between an open position to permit flow of contents from an associated drinking container and a closed position. Additionally, a removable cover 440 is mounted to exterior housing 406 to facilitate access to a battery (not shown).

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

The invention claimed is:

1. A system for use with a drinking container to provide a flow of air to a user, a temperature of the air being associated with a temperature of a thermal medium in the drinking container, the system comprising:

a lid assembly having a lid base and an exterior housing, the lid base being configured to removably mount to an open end of the drinking container to close the open end, the lid base having a drinking aperture defining a drinking opening, the exterior housing defining an interior compartment and having an air outlet, which pneumatically communicates with the interior compartment;

a fan mounted within the interior compartment;

a heat exchanger mounted to the lid assembly and extending downwardly from the lid assembly and toward a bottom of the drinking container such that the heat exchanger draws thermal energy from the thermal medium in the drinking container;

an annular seal positioned about the lid base and configured to prevent leakage of the thermal medium between the drinking container and the lid base;

an air inlet positioned above the annular seal such that, when mounted to the open end of the drinking container, the air inlet being positioned outside of the drinking container;

wherein, in operation, air is directed via rotation of the fan into a heat exchange relationship with the heat exchanger and then outwardly through the air outlet as the flow of air;

wherein the lid assembly is configured to permit flow of the thermal medium from within the drinking container and through the drinking opening for drinking by the user while the lid base is mounted to the open end of the drinking container and the fan is providing the flow of air; and wherein, in operation, at least some of the air entering the air inlet is directed downwardly into the heat exchanger and then upwardly toward the fan housing before being directed outwardly through the air outlet.

2. The system of claim 1, wherein the air inlet is defined by the exterior housing.

3. The system of claim 1, wherein the air inlet is defined by the lid base.

4. The system of claim 1, wherein the heat exchanger has an exterior surface formed of metal.

5. The system of claim 1, wherein the heat exchanger has a downwardly-directed flow portion and an upwardly-directed return flow portion.

6. The system of claim 1, wherein the drinking aperture is configured such that a drinking straw is receivable within the drinking opening.

7. The system of claim 6, further comprising the drinking straw.

8. The system of claim 6, further comprising the drinking container.

9. The system of claim 8, wherein the drinking container is a tumbler.

10. The system of claim 1, further comprising a battery mounted within the exterior housing.

11. The system of claim 10, wherein:

the battery is a rechargeable battery; and the system further comprises a charging unit electrically communicating with the rechargeable battery, the charging unit having a charging circuit mounted within the exterior housing and a charging port mounted to the exterior housing.

12. A system for use with a drinking container to provide a flow of air to a user, a temperature of the air being associated with a temperature of a thermal medium in the drinking container, the system comprising:

a lid assembly having a lid base and an exterior housing, the lid base being configured to removably mount to an open end of the drinking container to close the open end, the lid base having a drinking aperture defining a drinking opening, the exterior housing defining an interior compartment and having an air outlet, which pneumatically communicates with the interior compartment a fan mounted within the interior compartment and a heat exchanger mounted to the lid assembly and extending downwardly from the lid assembly and toward a bottom of the drinking container such that the heat exchanger draws thermal energy from the thermal medium in the drinking container;

wherein, in operation, air is directed via rotation of the fan into a heat exchange relationship with the heat exchanger and then outwardly through the air outlet as the flow of air; wherein the lid assembly is configured to permit flow of the thermal medium from within the drinking container and through the drinking opening for drinking by the user while the lid base is mounted to the open end of the drinking container and the fan is providing the flow of air;

wherein the lid base has an upper surface defining a liquid reservoir, the drinking aperture being positioned within the liquid reservoir; and wherein the air outlet is positioned outside of the liquid reservoir.

13. The system of claim 12, further comprising the drinking container.

14. A system for use with a drinking container to provide a flow of air to a user, a temperature of the air being associated with a temperature of a thermal medium in the drinking container, the system comprising:

a lid assembly having a lid base and an exterior housing, the lid base being configured to removably mount to an open end of the drinking container to close the open end, the lid base having a drinking aperture defining a drinking opening, the exterior housing defining an interior compartment and having an air outlet, which pneumatically communicates with the interior compartment a fan mounted within the interior compartment and a heat exchanger mounted to the lid assembly and extending downwardly from the lid assembly and toward a bottom of the drinking container such that the heat exchanger draws thermal energy from the thermal medium in the drinking container; and a fan housing, mounted within the interior compartment, and within which the fan is mounted;

wherein, in operation, air is directed via rotation of the fan into a heat exchange relationship with the heat exchanger and then outwardly through the air outlet as the flow of air;

wherein the lid assembly is configured to permit flow of the thermal medium from within the drinking container and through the drinking opening for drinking by the user while the lid base is mounted to the open end of the drinking container and the fan is providing the flow of air; and an outside surface of the fan housing and an inside surface of the exterior housing define a heat exchange flow path configured to direct at least some of the air entering the air inlet downwardly and into the heat exchange relationship with the heat exchanger.

15. The system of claim 14, wherein:

the lid base has a lower surface and a fan inlet, the fan inlet having a fan aperture, defining a fan opening in the lid base, and a fan inlet conduit positioned about the fan opening and extending downwardly from the lower surface of the lid base; and the heat exchange flow path is defined, at least in part, by the fan inlet conduit such that the air entering the heat exchange relationship with the heat exchanger flows downwardly outside of the fan inlet conduit and then is drawn upwardly and into the fan housing via the fan inlet conduit and through the fan opening.

16. The system of claim 14, further comprising the drinking container.

17. A system for use with a drinking container to provide a flow of air to a user, a temperature of the air being associated with a temperature of a thermal medium in the drinking container, the system comprising:

a lid assembly having a lid base and an exterior housing, the lid base being configured to removably mount to an open end of the drinking container to close the open end, the lid base having a drinking aperture defining a drinking opening, the exterior housing defining an interior compartment and having an air outlet, which pneumatically communicates with the interior compartment a fan mounted within the interior compartment and a heat exchanger mounted to the lid assembly and extending downwardly from the lid assembly and toward a bottom of the drinking container such that the heat exchanger draws thermal energy from the thermal medium in the drinking container;

wherein, in operation, air is directed via rotation of the fan into a heat exchange relationship with the heat exchanger and then outwardly through the air outlet as the flow of air;

wherein the lid assembly is configured to permit flow of the thermal medium from within the drinking container and through the drinking opening for drinking by the user while the lid base is mounted to the open end of the drinking container and the fan is providing the flow of air; and wherein a centerline of the fan is offset with respect to a centerline of the lid base such that the centerline of the lid base is located between the drinking aperture and the centerline of the fan.

18. The system of claim 17, further comprising the drinking container.

* * * * *